US005589842A

United States Patent [19]

Wang et al.

[11] Patent Number: 5,589,842

[45] Date of Patent: Dec. 31, 1996

[54] COMPACT MICROSTRIP ANTENNA WITH MAGNETIC SUBSTRATE

[75] Inventors: Johnson J. H. Wang, Marietta; Victor K. Tripp, Tucker, both of Ga.

[73] Assignee: Georgia Tech Research Corporation, Atlanta, Ga.

[21] Appl. No.: 594,330

[22] Filed: Jan. 30, 1996

Related U.S. Application Data

[60] Continuation of Ser. No. 335,489, Nov. 7, 1994, abandoned, which is a division of Ser. No. 217,006, Mar. 23, 1994, Pat. No. 5,453,752, which is a continuation of Ser. No. 7,409, Jan. 22, 1993, abandoned, which is a continuation of Ser. No. 798,700, Nov. 26, 1991, abandoned, which is a continuation-in-part of Ser. No. 695,686, May 3, 1991, abandoned.

[51] Int. Cl.[6] ..... H01Q 1/38; H01Q 25/04; H01Q 1/36

[52] U.S. Cl. ..... 343/787; 343/895; 343/700 MS

[58] Field of Search ..... 343/700 MS, 895, 343/873, 787, 788, 792.5

[56] References Cited

U.S. PATENT DOCUMENTS

| | | | |
|---|---|---|---|
| 3,811,128 | 5/1974 | Munson | 343/787 |
| 3,949,407 | 4/1976 | Jagdmann et al. | 343/895 |
| 4,101,899 | 7/1978 | Jones, Jr. et al. | 343/895 |
| 4,525,720 | 6/1985 | Corzine et al. | 343/895 |

FOREIGN PATENT DOCUMENTS

| | | | |
|---|---|---|---|
| 1157600 | 5/1985 | U.S.S.R. | 343/787 |
| 9311582 | 6/1993 | WIPO | 343/700 MS |

OTHER PUBLICATIONS

Bozorth, Ferromagnetism, IEEE Press, Piscataway, NJ Copyright 1978, AT&T, pp. 5 & 6.

*Primary Examiner*—Peter Toby Brown
*Attorney, Agent, or Firm*— Deveau, Colton & Marquis

[57] ABSTRACT

A compact broadband microstrip antenna for mounting to one side of a ground plane comprises a closed (usually circular) array of antenna elements positioned to one side of a substrate for spacing the antenna elements a selected distance above the ground plane, the antenna elements being adapted to be electrically driven out of phase from one another to excite one or more spiral modes. In another form, a compact microstrip antenna comprises one or more antenna elements positioned to one side of a magnetic substrate for spacing the antenna elements a selected distance from a ground plane, the magnetic substrate being chosen to have a relative permittivity which is roughly equal to its relative permeability. In a third form, a microstrip antenna is adapted for operating in a single mode and radiation from other modes is suppressed by varying the spacing above the ground plane in the radiation zones so that only radiation in the desired mode is fostered. The disclosed antenna achieves a reduction in physical size at a sacrifice of bandwidth and gain.

6 Claims, 8 Drawing Sheets

COMPACT MICROSTRIP ANTENNA WITH MAGNETIC SUBSTRATE

This invention was made with partial Government support under a contract from the U.S. Air Force. The Government has certain rights in the invention.

This is a continuation of Ser. No. 08/335,489, filed on 7 Nov. 1994 and now abandoned, which is a division of Ser. No. 08/217,006, filed 23 Mar. 1994, now U.S. Pat. No. 5,453,752, which is a continuation of Ser. No. 08/007,409, filed 22 Jan. 1993 now abandoned, which is a continuation of Ser. No. 07/798,700, filed 26 Nov. 1991, now abandoned, which is a continuation in part of Ser. No. 07/695,686, filed 3 May 1991 and now abandoned.

TECHNICAL FIELD

The present invention relates generally to antennas, and more particularly relates to microstrip antennas.

BACKGROUND OF THE INVENTION

In many antenna applications, for example such as for use with aircraft and vehicles, an antenna with a broad bandwidth is required. For such applications, the so-called "frequency-independent antenna" ("FI antenna") commonly has been employed. See for example, V. H. Rumsey, Frequency Independent Antennas, Academic Press, New York, N.Y., 1966. Such frequency-independent antennas typically have a radiating or driven element with spiral, or log-periodic structure that enables the frequency-independent antenna to transmit and receive signals over a wide band of frequencies, typically on the order of a 9:1 ratio or more (a bandwidth of 900%). For example, European Patent Application No. 86301175.5 of R. H. DuHamel entitled "Dual Polarized Sinuous Antennas", published October 22, 1986, publication No. 0198578 (See also U.S. Pat. No. 4,658,262 dated Apr. 14, 1987), discloses frequency-independent antennas with a log-periodic structure called "sinuous. "

In a conventional frequency-independent antenna, a lossy cylindrical cavity is positioned to one side of the antenna element so that when transmitting, energy effectively is radiated outwardly from the antenna only from one side of the antenna element (the energy radiating from the other side of the antenna element being dissipated in the cavity). However, high-performance aircraft, and other applications as well, require that the antenna be mounted substantially flush with its exterior surface, in this case the skin of the aircraft. This undesirably requires that the cavity portion of the frequency-independent antenna be mounted within the structure of the aircraft, necessitating that a substantial hole be formed therein to accommodate the cylindrical cavity, which typically is at least two inches deep and several inches in diameter. Also, the use of a lossy cavity to dissipate radiation causes about half of the radiated power to be lost, requiring a greater power input to effect a given level of power radiated outwardly from the frequency-independent antenna.

In recent years the so-called "microstrip patch antenna" has been developed. See for example, U.S. Pat. No. Re. 29,911 of Munson (a reissue of U.S. Pat. No. 3,921,177) and U.S. Pat. No. Re. 29,296 of Krutsinger, et al. (a reissue of U.S. Pat. No. 3,810,183). In a typical microstrip patch antenna, a thin metal patch, usually of circular or rectangular shape, is placed adjacent to a ground plane and is spaced a small distance therefrom by a dielectric spacer. Microstrip patch antennas have generally suffered from having a narrow useful bandwidth, typically less than 10%.

U.S. patent application Ser. No. 07/695,686, now abandoned, recites a multi-octave spiral-mode microstrip antenna which overcomes many of the prior art limitations. This spiral-mode antenna approaches the bandwidth of frequency-independent antennas and is nearly flushly mounted above a ground plane. However, multi-mode operation of a spiral-mode microstrip antenna requires the spiral to be of circumference at least $m\lambda$, where m is the highest desired mode and $\lambda$ is the wavelength. Thus, the spiral diameter can become undesirably large, especially at lower frequencies.

Microstrip patch array antennas have also been known in the art. See, for example, Munson, R. E., *Conformal Microstrip Antennas and Microstrip Phased Arrays, IEEE Transactions on Antennas and Propogation,* p. 74 (January 1974). The Munson article discusses an array of rectangular elements. However, known microstrip arrays, including the Munson design, generally are electrically large (i.e., the antenna is relatively large in comparison with the wavelength of the operating frequency), having individual elements of approximately one-half wavelength in diameter and spaced from one another a distance slightly greater than their diameters.

U.S. Pat. No. 4,766,444 of Conroy et al relates to a conformal "cavity-less" antenna having an array of single-arm spiral elements driven in unison and which are aligned linearly along an outwardly-curved surface. A lossy hex-cell structure spaces the spiral elements away from the ground plane and takes the place of the typical cavity. The resulting antenna is disclosed as being suited for use as an interferometer and tends to suffer from having a narrow useful bandwidth. Again this is an electrically large array.

Accordingly, it can be seen that a need yet remains for an structure which has a low profile, has a broad bandwidth relative to prior antennas, and is small in physical size. It is the provision of such an antenna that the present invention is primarily directed.

SUMMARY OF THE INVENTION

Briefly described, the present invention comprises a compact broadband microstrip antenna. In a first preferred form, the invention comprises a microstrip antenna for mounting to one side of a ground plane or other surface, the antenna comprising a closed (typically circular) array of antenna elements, each element positioned to one side of a substrate for spacing the elements a selected distance from the ground plane, the substrate having a low dielectric constant. The elements are adapted to be electrically driven out of phase from one another to excite spiral modes.

Preferably, the closed array comprises a circular arrangement of four or more elements, each element being made from a thin metal foil. Preferably, the substrate has a dielectric constant of between 1 and 4.5. Also, the thickness of the substrate is carefully selected to get near maximum gain at a particular wavelength, with the substrate having a thickness typically in the range of 0.1 to 0.30 inches for microwave frequencies of 2 to 18 GHz. The substrate thickness for other frequencies is determined by the frequency scaling method. Also, a loading material can be positioned adjacent the antenna elements.

With this construction, an antenna is provided which can be mounted externally to a structure and which can be conformed to the surface thereof. Also, the antenna exhibits a fairly broad bandwidth, typically on the order of 300%.

This design is based on the discovery by the applicants that the ground plane of a microstrip antenna is compatible with the spiral modes of the antenna. In this regard, the individual elements of the closed array are electrically driven out of phase with one another in a manner to cause the aggregate antenna to generate a beam pattern according a desired spiral mode or modes, for example, modes m=1 and m=2.

In a second preferred form, the invention comprises a microstrip antenna for mounting to one side of a ground plane or other surface, the antenna comprising one or more antenna elements positioned to one side of a magnetic substrate for spacing the antenna elements a selected distance from the ground plane. The magnetic substrate is chosen to have a relative permittivity which is roughly equal to its relative permeability. This allows the antenna to generate multiple spiral modes effectively, without the ill-effects of having a substrate with a high dielectric constant.

In a third preferred form, the present invention comprises a microstrip antenna for mounting to one side of a ground plane and includes one or more antenna elements positioned to one side of a substrate. Particularly, the antenna is adapted for operating in a particular mode, for example mode m=2. To this end, radiation in the radiation zone for the m=1 mode is suppressed with a relatively close spacing of the antenna element relative to the ground plane. The mode m=2 is fostered by having a sufficiently large spacing between the antenna element and the ground plane in the m=2 radiation zone. This takes advantage of the fact that an antenna radiates in radiation zones roughly corresponding to circles having circumferences equal to $m\lambda$, where $\lambda$ is the wavelength and m is the radiation mode or spiral mode. Thus, an antenna tends to radiate in the first radiation zone for mode m=1 and radiates at a second, outer radiation zone for mode m=2. By selectively varying the spacing between the ground plane and the antenna element in these various radiation zones, the radiation in the m=1 mode can be suppressed, while fostering radiation in the mode m=2. Of course, it is possible to reverse this so that the spacing suppresses radiation in the mode m=2 and fosters radiation in the mode=1 region, although in many instances there is no need to do this because it is possible to eliminate the mode m=2 radiation by truncating the antenna element so that there is no radiation zone which is large enough to support mode m=2 radiation.

These arrangements are quite compact and efficient. Also, the capability of selectively operating in one mode, or in several modes, allows the antenna to be useful in beam steering and null steering.

Accordingly, it is a primary object of the present invention to provide a compact antenna which has a fairly broad bandwidth performance, while having a low profile.

It is another object of the present invention to provide a microstrip antenna which has an improved bandwidth.

It is another object of the present invention to provide an antenna having a small aperture.

It is another object of the present invention to provide an antenna capable of beam and null steering.

Other objects, features, and advantages of the present invention will become apparent upon reading the following specification in conjunction with the accompanying drawing figures.

BRIEF DESCRIPTION OF THE DRAWING FIGURES

DETAILED DESCRIPTION

As noted above, the present application is a continuation-in-part of U.S. application Ser. No. 07/695,686, now abandoned. Sections numbered 1–3 below are drawn substantially verbatim from the above-identified application and illustrate some of the principles of the present invention, particularly including the principles of how the antenna and its elements are mounted and spaced above a ground plane. The sections that follow numbered sections 1–3 provide the remainder of the disclosure of the present invention, including how the antenna is comprised of phased array elements, or uses a magnetic substrate material, or has a non-constant spacing between the antenna element(s) and the substrate as a function of radius.

1. The Physical Structure of the Mounting of the Antenna

Figure 1:
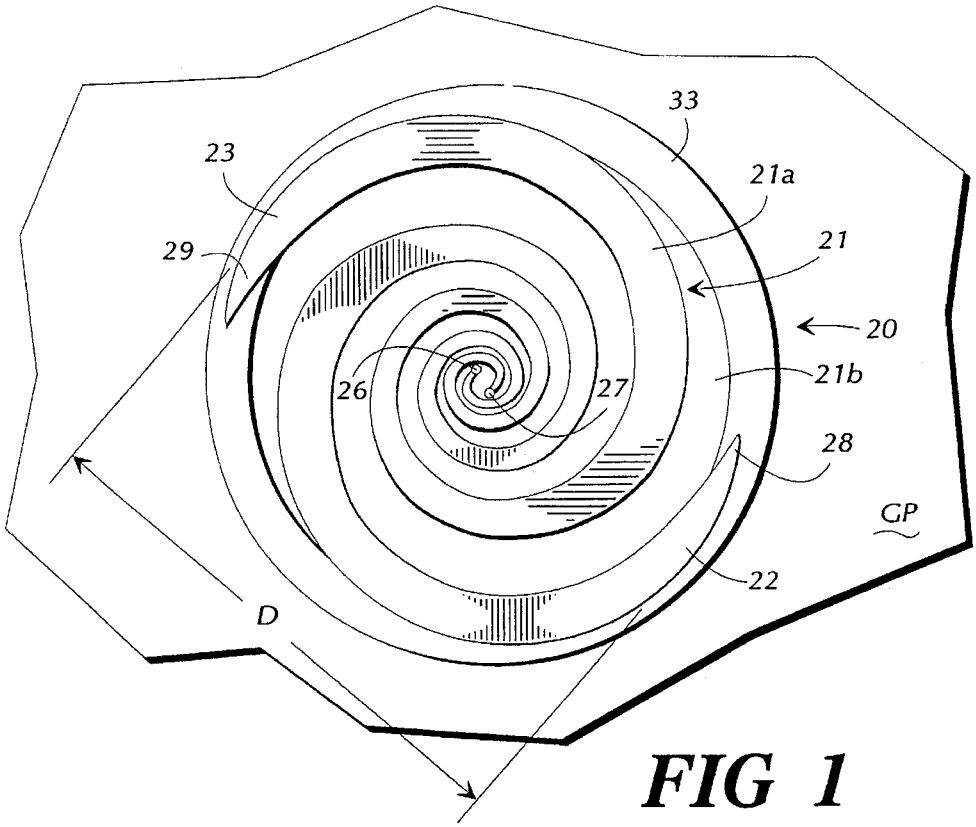
FIG. 1 is a plan view of a microstrip antenna in a preferred form of the invention.
Figure 2A:
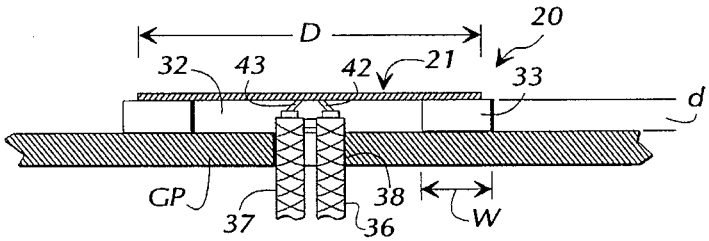
FIG. 2A is a schematic, partially sectional side view of the antenna of FIG. 1.
Figure 2B:
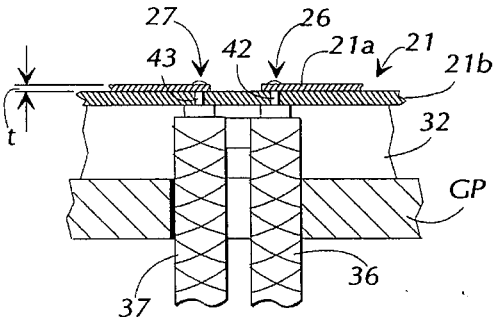
FIG. 2B is a schematic, partially sectional side view of a portion of the antenna of FIG. 2A.

Referring now in detail to the drawing figures, wherein like reference characters represent like parts throughout the several views, FIGS. 1, 2A and 2B show a multi-octave microstrip antenna 20, according to a preferred form of the invention and shown mounted to one side of a ground plane GP. The antenna 20 includes an antenna element 21 comprising a very thin metal foil 21*a*, preferably copper foil, and a thin dielectric backing 21*b*. The antenna element foil 21*a* shown in FIGS. 1, 2A and 2B has a spiral shape or pattern including first and second spiral arms 22 and 23. Spiral arms 22 and 23 originate at terminals 26 and 27 roughly at the center of antenna element 21. The spiral arms 22 and 23 spiral outwardly from the terminals 26 and 27 about each other and terminate at tapered ends 28 and 29, thereby roughly defining a circle having a diameter D and a corresponding circumference of $\pi D$ . The antenna element foil 21*a* is formed from a thin metal foil or sheet of copper by any of well known means, such as by machining, stamping, chemical etching, etc. Antenna element foil 21*a* has a thickness t of less than 10 mils or so, although other thicknesses obviously can be employed as long as it is thin in terms of the wavelength, say for example, 0.01 wavelength or less. While the invention is disclosed herein connection with a separate ground plane GP, it will be obvious to those skilled in the art that the antenna can be constructed to include its own ground plane, making the antenna suitable for mounting on non-conducting surfaces, e.g., on engineering plastics and composites.

The thin antenna element 21 is flexible enough to be mounted to generally nonplanar, contoured shapes of the ground plane, although in FIGS. 2A and 2B the ground plane is represented as being truly planar. The antenna element foil 21*a* is uniformly spaced a selected distance d (the standoff distance) from the ground plane GP by a dielectric spacer 32 positioned between the antenna element 21 and the ground plane GP. The dielectric spacer 32 preferably has a low dielectric constant, in the range of 1 to 4.5, as will be discussed in more detail below. The dielectric spacer 32 is generally in the form of a disk and is sized to be slightly smaller in diameter than the antenna element 21. The thickness d of the dielectric spacer 32 typically is much greater than the thickness of the dielectric backing 21*b* of the antenna element 21. The thickness d of spacer 32 typically is in the neighborhood of 0.25" for microwave frequencies. However, the specific thickness chosen to provide a maximum gain for a given frequency should be no greater than one-half of the wavelength of the frequency in the medium of the dielectric spacer.

A loading 33 comprising a microwave absorbing material, such as carbon-impregnated foam, in the shape of a ring is positioned concentrically about dielectric spacer 32 and extends partially beneath antenna element 21. Alternatively, a paint laden with carbon can be applied to the outer edge of the antenna element. Also, the antenna element can be provided with a peripheral shorting ring positioned adjacent and just outside the spiral arms 22 and 23 and the peripheral shorting ring (unshown) can be painted with the carbon-laden paint.

First and second coaxial cables 36 and 37 extend through an opening 38 in the ground plane GP for electrically coupling the antenna element 21 with a feed source, driver or detector. The coax cables 36 and 37 include central shielded electric cables 42 and 43 which are respectively connected with the terminals 26 and 27. The outer shieldings of the coaxial cables 36 and 37 are electrically coupled to each other in the vicinity of the antenna element, as shown in FIG. 2B. As shown schematically in FIG. 3, this electrical coupling of the shielding of the coaxial cables can be accomplished by soldering a short electric cable 44 at its ends to each of the coaxial cables 36 and 37.

Figure 3:
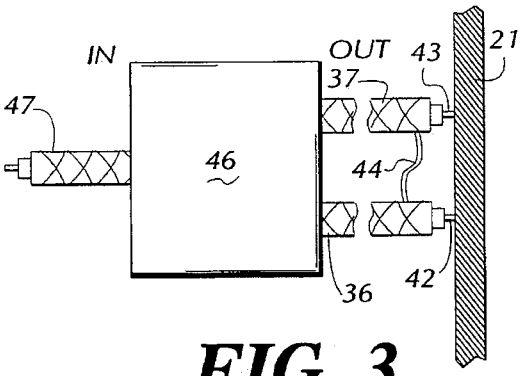
FIG. 3 is a schematic view of a feed for driving the antenna of FIG. 1.

Preferably, as shown in FIG. 3, the coaxial cables 36 and 37 are-connected to a conventional RF hybrid unit 46 which is in turn connected with a single coax cable input 47. The function of the RF hybrid unit 46 is to take a signal carried on the input coax cable 47 and split it into two signals, with one of the signals being phase-shifted 180° relative to the other signal. The phase-shifted signals are then sent out through the coaxial cables 36 and 37 to the antenna element 21. By providing two signals, phase-shifted 180° relative to each other, to the two antenna element arms, a voltage potential is developed across the terminals 26 and 27 corresponding to the waveform carried along the coaxial cables 36, 37 and 47, causing the antenna to radiate primarily in a n=1 mode (although some components of higher-order modes can be present). As an alternative, a balun may be used to split the input signal into first and second signals, with one of the signals being delayed relative to the other. A balun can be used to feed the antenna for operating in the n=1 mode (single beam pattern). The RF hybrid circuit can be used for generating higher-order modes, e.g., n=2. For generating these higher-order modes, 4, 6, or 8 antenna element arms are used in conjunction with a corresponding number of feed terminals.

Figure 4A:
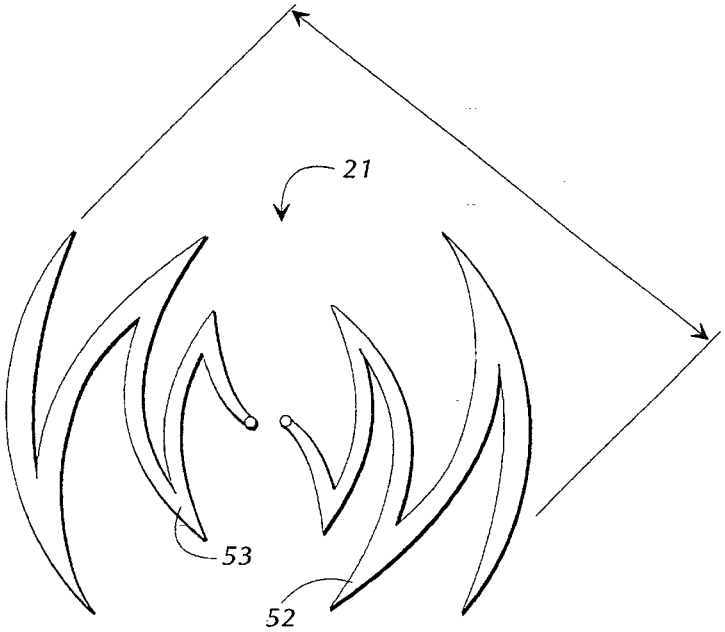
FIGS. 4A and 4B are plan views of modified forms of the antenna of FIG. 1, depicting sinuous antenna elements.
Figure 4B:
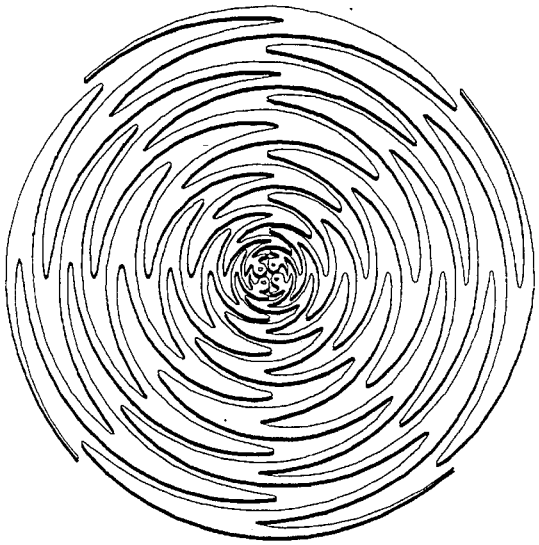

FIG. 4A shows an alternative embodiment of the antenna of FIG. 1, with the spiral arms 22 and 23 of FIG. 1 being replaced with sinuous arms 52 and 53. While a two-arm sinuous antenna element is shown in FIG. 4A, a four-arm sinuous antenna element can be provided if higher-order modes are desired, as shown in FIG. 4B.

Figure 5A:
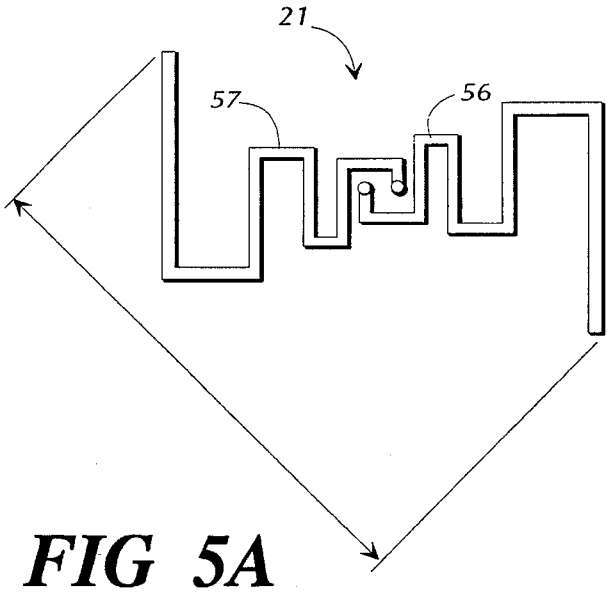
FIGS. 5A and 5B are plan views of modified forms of the antenna of FIG. 1, depicting log-periodic tooth antenna elements.
Figure 5B:
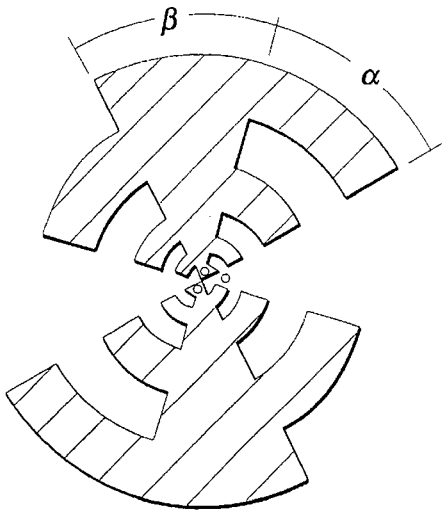

FIG. 5A shows a modified form of the antenna element 21 in which the spiral arms 22 and 23 are replaced with log-periodic toothed arms 56 and 57. The toothed antenna element illustratively shown in FIG. 5A includes toothed arms which have linear segments which are perpendicular to each other, i.e., the "teeth" of each arm are generally rectangular. Alternatively, the teeth can be smoothly contoured to eliminate the sharp corners at each tooth. Also, the teeth can be curved as shown in FIG. 5B.

Figure 6:
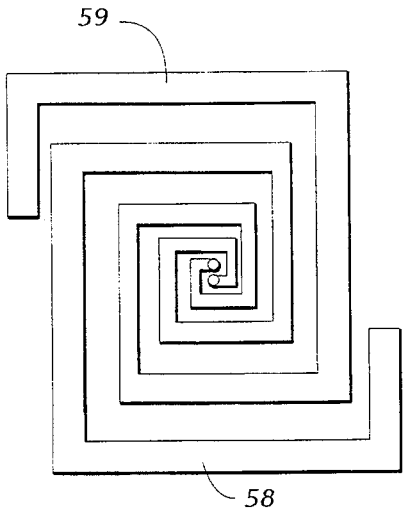
FIG. 6 is a plan view of a modified form of the antenna of FIG. 1, depicting a rectangular spiral antenna element.
Figure 7:
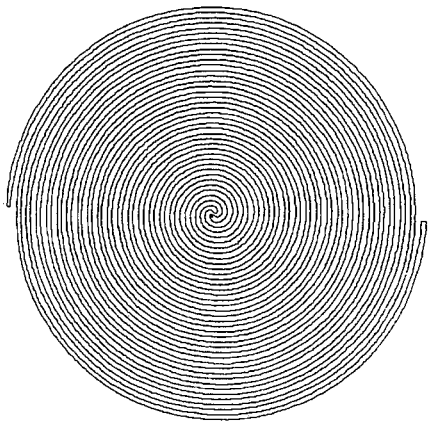
FIGS. 7 and 8 are plan views of modified forms of the antenna on FIG. 1, depicting Archimedean and equiangular spiral antenna elements, respectively.
Figure 8:
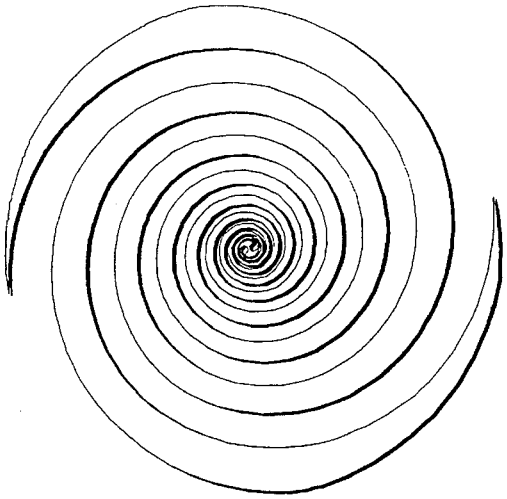

FIG. 6 shows another modified form of the antenna element of FIG. 1 in which the spiral arms 22 and 23 are replaced with rectangular spiral arms 58 and 59. Each of the Greek spiral arms is in the form of a spiraling square, as compared with the rounded spiral of the antenna element of FIG. 1. FIGS. 7 and 8 show that the spiral pattern of FIG. 1 can be provided as an "Archimedean spiral" as shown in FIG. 7 or as an "equiangular spiral" as shown in FIG. 8.

2. Theoretical Basis of the Mounting Arrangement

The following discussion represents the results of a theoretical study by applicants establishing the viability of the invention. Experimental verification of the theoretical basis will be provided in the section immediately following this one.

The basic planar spiral antenna, which consists of a planar sheet of an infinitely large spiral structure, radiates on both sides of the spiral in a symmetric manner. When radiating in n=1 mode, most of the radiation occurs on a circular ring around the center of the spiral whose circumference is approximately one wavelength. As a result, one can truncate the spiral outside this active region without too much disruption to its pattern, or dissipative loss to its radiated power.

Figure 9A:
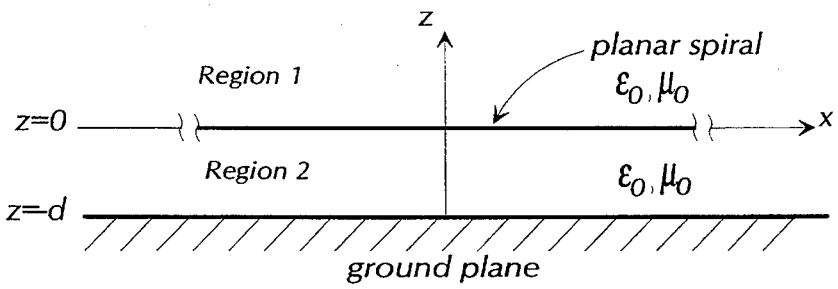
FIGS. 9A and 9B and 10A and 10B are schematic illustrations of mathematical models used to analyze the theoretical basis of the antenna of FIG. 1.
Figure 9B:
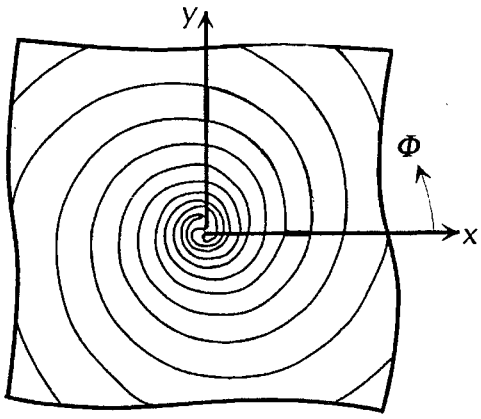

FIGS. 9A and 9B depict an infinite, planar spiral backed by a ground plane. The spiral mode fields in Region 1 can be decomposed into TE and TM fields in terms of vector potentials Fl and Al as follows $$F_l=\hat{z}F_l\psi_l \text{ TE Solution} \tag{1}$$

$$A_l=\hat{z}A_l\psi_l \text{ TM Solution} \tag{2}$$

In Region 1 where modes propagate in the +z direction, we have $$\psi_l = e^{jn\phi}\int_o^\infty g_l(k_\rho)J_n(k_\rho\rho)e^{-jk_{zl}z}k_\rho dk_\rho \tag{3}$$

$$k_{zl} = [k_l^2 - k_\rho^2]^{1/2}$$

$$k_l = \omega(\epsilon_o\mu_o)^{1/2} \tag{4}$$

and the explicit expressions for the fields in region 1, where l=1. are given by:

$$E_{\rho l}=\frac{A_l}{j\omega\epsilon_l}\frac{\partial^2\psi_l}{\partial\rho\partial z}-\frac{F_l}{\rho}\frac{\partial\psi_l}{\partial\phi}= \tag{5}$$

$$e^{jn\phi}\int_o^\infty g(k_\rho)e^{-jk_{zl}z}\left[\frac{-A_l}{\omega\epsilon_o}k_\rho J_n'(k_\rho\rho)k_{zl}-\frac{F_{ljn}}{\rho}J_n(k_\rho\rho)\right]k_\rho dk_\rho$$

$$E_{\phi l}=\frac{A_l}{j\omega\epsilon_o\rho}\frac{\partial^2\psi_l}{\partial\phi\partial z}+F_l\frac{\partial\psi_l}{\partial\rho}= \tag{6}$$

$$e^{jn\phi}\int_o^\infty g(k_\rho)e^{-jk_{zl}z}\left[\frac{A_l nk_{zl}}{j\omega\epsilon_o\rho}J_n(k_\rho\rho)+F_l k_\rho J_n'(k_\rho\rho)\right]k_\rho dk_\rho$$

$$E_{zl}=\frac{A_l}{j\omega\epsilon_o}\left(\frac{\partial^2}{\partial z^2}+k_l^2\right)\psi_l= \tag{7}$$

$$\frac{A_l}{j\omega\epsilon_o}\int_o^\infty g(k_\rho)e^{-jk_{zl}z}[-k_{lz}^2+k_l^2]J_n(k_\rho\rho)k_\rho dk_\rho$$

$$H_{\rho l}=\frac{A_l}{\rho}\frac{\partial\psi_l}{\partial\phi}+\frac{F_l}{j\omega\mu_l}\frac{\partial^2\psi_l}{\partial\rho\partial z}= \tag{8}$$

$$e^{jn\phi}\int_o^\infty g(k_\rho)e^{-jk_{zl}z}\left[\frac{A_l jn}{\rho}J_n(k_\rho\rho)-\frac{F_l k_{zl}k_\rho}{\omega\mu_l}J_n'(k_\rho\rho)\right]k_\rho dk_\rho$$

$$H_{\phi l}=-A_l\frac{\partial\psi_l}{\partial\rho}+\frac{F_l}{j\omega\mu_l\rho}\frac{\partial^2\psi_l}{\partial\phi\partial z}= \tag{9}$$

$$e^{jn\phi}\int_o^\infty g(k_\rho)e^{-jk_{zl}z}\left[-A_l k_\rho J_n'(k_\rho\rho)-\frac{F_l nk_{zl}}{j\omega\mu_l\rho}J_n(k_\rho\rho)\right]k_\rho dk_\rho$$

$$H_{zl}=\frac{F_l}{j\omega\mu_l}\frac{\partial^2}{\partial z^2}+k_l^2)\psi_l= \tag{10}$$

$$\frac{F_l}{j\omega\mu_l}e^{jn\phi}\int_o^\infty g(k_\rho)e^{-jk_{zl}z}[-k_{zl}^2+k_l^2]J_n(k_\rho\rho)k_\rho dk_\rho$$

In Region 2, modes propagating in both +z and −z directions exist and therefore the vector potentials are $$F_2^\pm=\hat{z}F_2^\pm\psi_2^\pm \text{ TE solution} \tag{11}$$

$$A_2^\pm=\hat{z}A_2^\pm\psi_2^\pm \text{ TM solution} \tag{12}$$

where $$\psi_2^\pm = e^{jn\phi}\int_o^\infty g(k_\rho)J_n(k_\rho\rho)\,e^{\mp jk_z z}\,k_\rho dk_\rho \tag{13}$$

The explicit expressions for the fields in Region 2 are as follows.

$$E_{\rho 2}=e^{jn\phi}\int_o^\infty g(k_\rho)\,[-A_2^+e^{-jk_z z}+A_2^-e^{jk_z z}]\frac{k_z k_\rho^2}{\omega\epsilon_o}J_n'(k_\rho\rho)\,dk_\rho+e^{jn\phi}\int_0^\infty g(k_\rho)[-F_2^+e^{-jk_z z}-F_2^-e^{jk_z z}]\frac{jnk_\rho}{\rho}J_n(k_\rho\rho)\,dk_\rho \tag{14}$$

$$E_{\phi 2}=e^{jn\phi}\int_o^\infty g(k_\rho)\,[A_2^+e^{-jk_z z}-A_2^-e^{jk_z z}]\frac{nk_z k_\rho}{j\omega\epsilon_o\rho}J_n(k_\rho\rho)dk_\rho+e^{jn\phi}\int_0^\infty g(k_\rho)[F_2^+e^{-jk_z z}+F_2^-e^{jk_z z}]\,k_\rho^2J_n'(k_\rho\rho)\,dk_\rho \tag{15}$$

$$E_{z2}=\frac{1}{j\omega\epsilon_o}\int_o^\infty g(k_\rho)J_n(k_\rho\rho)[A_2^+e^{-jk_z z}+A_2^-e^{jk_z z}]\,k_\rho^3dk_\rho \tag{16}$$

$$H_{\rho 2}=e^{jn\phi}\int_0^\infty g(k_\rho)\,[A_2^+e^{-jk_z z}+A_2^-e^{jk_z z}]\frac{jnk_\rho}{\rho}J_n(k_\rho\rho)\,dk_\rho+e^{jn\phi}\int_0^\infty g(k_\rho)[-F_2^+e^{-jk_z z}+F_2^-e^{jk_z z}]\frac{k_z k_\rho^2}{\omega\mu_o}J_n'(k_\rho\rho)\,dk_\rho \tag{17}$$

$$H_{\phi 2}=e^{jn\phi}\int_o^\infty g(k_\rho)\,[-A_2^+e^{-jk_z z}-A_2^-e^{jk_z z}]k_\rho^2J_n'(k_\rho\rho)\,dk_\rho+e^{jn\phi}\int_o^\infty g(k_\rho)[+F_2^+e^{-jk_z z}-F_2^-e^{jk_z z}]\frac{nk_z k_\rho}{j\omega\mu_o\rho}J_n(k_\rho\rho)\,dk_\rho \tag{18}$$

$$H_{z2}=\frac{1}{j\omega\mu_o}\int_o^\infty g(k_\rho)J_n(k_\rho\rho)[F_2^+e^{-jk_z z}+F_2^-e^{jk_z z}]k_\rho^3dk_\rho \tag{19}$$

By matching the boundary conditions at z=0 (where tangential E and H are continuous in the aperture region) and z=−d (where tangential E vanishes) and by requiring the fields satisfy the impedance conditions $$E_1=j\eta H_1,\ E_2^+=j\eta H_2^+,\ E_2^-=-j\eta H_2^- \tag{20}$$

we obtain the necessary and sufficient conditions for the spiral modes as follows:

$$A_1=A_2^+-A_2^-$$

$$F_1=F_2^++F_2^-$$

$$-A_2^+e^{jk_z d}+A_2^-e^{-jk_z d}=o$$

$$F_2^+e^{jk_z d}+F_2^-e^{-jk_z d}=o$$

$$F_1=-j\eta A_1$$

$$F_2^+=-j\eta A_2^+$$

$$F_2^-=j\eta A_2^- \tag{21}$$

There are six unknowns in the above seven equations. However, the seven equations are not totally independent, and can be reduced to the following five independent equations.

$$F_1=F_2^{+}+F_2^{-}$$

$$F_2^{+}e^{jk_z d}+F_2^{-}e^{-jk_z d}=o$$

$$F_1=-j\eta A_1$$

$$F_2^{+}=-j\eta A_2^{+}$$

$$F_2^{-}=j\eta A_2^{-} \tag{22}$$

Equations (22) have six parameters in the five equations. Let, say $A_1$, be given, then we can solve for all the other five parameters. Thus the spiral radiation modes can be supported by the structure of an infinite planar spiral backed by a ground plane as shown in FIG. 1. This finding is the design basis of the multi-octave spiral-mode microstrip antennas disclosed herein.

In practice, the spiral is truncated. The residual current on the spiral beyond the mode-1 active region, therefore, faces a discontinuity where the energy is diffracted and reflected. The diffracted and reflected power due to the truncation of the spiral, as well as possible mode impurity at the feed point, is believed to degrade the radiation pattern. Indeed, this is consistent with what we have observed.

Figure 10A:
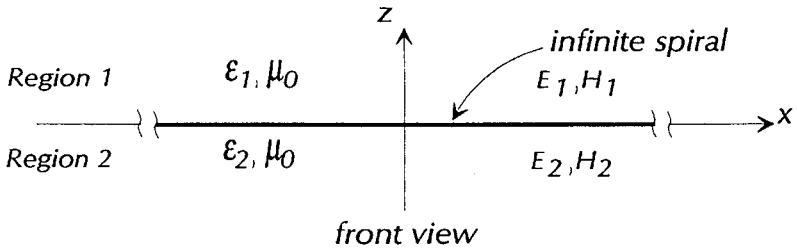
Figure 10B:
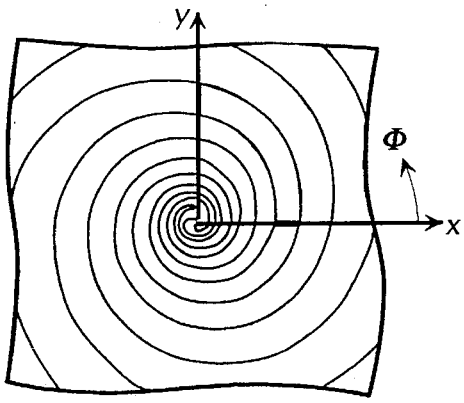

To examine the effect of a dielectric substrate on the spiral microstrip antenna, we study the simpler problem of an infinite spiral between two media, as shown in FIGS. 10A and 10B.

Region 1 is usually free space ($\epsilon_{1=\epsilon o}$) where radiation is desired. Region 2 is an infinite dielectric medium with $\epsilon_2$ and $\mu_o$. Following the method of Section I, we express the fields in both Region 1 and Region 2 in terms of electric and magnetic vector potentials Fl and Al.

The explicit expressions for fields in Region l (l=1 or 2) are $$E_{\rho l}=\frac{A_l}{j\omega\epsilon_l}\frac{\partial^2\psi_l}{\partial\rho\partial z}=\frac{F_l}{\rho}\frac{\partial\psi_l}{\partial\phi}= \tag{23}$$

$$e^{jn\phi}\int_o^{\infty} g(k_\rho)e^{-jk_{zl}z}\left[\frac{-A_l}{\omega\epsilon_l}k_\rho J_n'(k_\rho\rho)k_{zl}-\frac{F_l jn}{\rho}J_n(k_\rho\rho)\right]k_\rho dk_\rho$$

$$E_{\phi l}=\frac{A_l}{j\omega\epsilon_l\rho}\frac{\partial^2\psi_l}{\partial\phi\partial z}+F_l\frac{\partial\psi_l}{\partial\rho}= \tag{24}$$

$$e^{jn\phi}\int_o^{\infty} g(k_\rho)e^{-jk_{zl}z}\left[\frac{A_l nk_{zl}}{j\omega\epsilon_l\rho}J_n(k_\rho\rho)+F_l k_\rho J_n'(k_\rho\rho)\right]k_\rho dk_\rho$$

$$E_{zl}=\frac{A_l}{j\omega\epsilon_l}\left(\frac{\partial^2}{\partial z^2}+k_l^2\right)\psi_l= \tag{25}$$

$$\frac{A_l}{j\omega\epsilon_l}\int_o^{\infty} g(k_\rho)e^{-jk_{zl}z}[-k_{lz}^2+k_l^2]J_n(k_\rho\rho)k_\rho dk_\rho$$

$$H_{\rho l}=\frac{A_l}{\rho}\frac{\partial\psi_l}{\partial\phi}+\frac{F_l}{j\omega\mu_l\rho}\frac{\partial^2\psi_l}{\partial\rho\partial z}= \tag{26}$$

$$e^{jn\phi}\int_o^{\infty} g(k_\rho)e^{-jk_{zl}z}\left[\frac{A_l jn}{\rho}J_n(k_\rho\rho)-\frac{F_l k_{zl}k_\rho}{\omega\mu_l}J_n'(k_\rho\rho)\right]k_\rho dk_\rho$$

$$H_{\phi l}=-A_l\frac{\partial\psi_l}{\partial\rho}+\frac{F_l}{j\omega\mu_l\rho}\frac{\partial^2\psi_l}{\partial\phi\partial z}= \tag{27}$$

-continued $$e^{jn\phi}\int_o^{\infty} g(k_\rho)e^{-jk_{zl}z}\left[-A_l k_\rho J_n'(k_\rho\rho)-\frac{F_l nk_{zl}}{j\omega\mu_l\rho}J_n(k_\rho\rho)\right]k_\rho dk_\rho$$

$$H_{zl}=\frac{F_l}{j\omega\mu_l}\left(\frac{\partial^2}{\partial z^2}+k_l^2\right)\psi_l= \tag{28}$$

$$\frac{F_l}{j\omega\mu_l}e^{jn\phi}\int_o^{\infty} g(k_\rho)e^{-jk_{zl}z}[-k_{zl}^2+k_l^2]J_n(k_\rho\rho)k_\rho dk_\rho$$

Continuity of the tangential E field at z=0 in the aperture region requires $$\frac{-A_1}{\omega\epsilon_1}k_\rho k_{z1}=\frac{A_l k_{z2}k_\rho}{\omega\epsilon_2} \tag{29}$$

$$\frac{F_1 jn}{\rho}=\frac{F_2 jn}{\rho}$$

$$\frac{A_1 nk_{z1}}{j\omega\epsilon_1\rho}=\frac{-A_2 nk_{z2}}{j\omega\epsilon_2\rho}$$

$$F_j k_\rho=F_2 k_\rho$$

Eq. (29) can be reduced to $$\frac{-A_1 k_{z1}}{\epsilon_1}=\frac{A_2 k_{z2}}{\epsilon_2} \tag{30}$$

$$F_l=F_2$$

The impedance condition $$E_1=j\eta_1 H_1 \tag{31}$$

requires $$\frac{A_1}{\epsilon_1}=\frac{j\eta_1 F_1}{\mu_1} \tag{32}$$

$$-F_l=j\eta_1 A_l$$

which can be reduced to $$F_1=-j\eta_1 A_1 \tag{33}$$

Similarly, $$E_2=-j\eta_2 H_2 \tag{34}$$

requires $$F_2=j\eta_2 A_2 \tag{35}$$

Eqs. (30), (34) and (35) are constraints on $A_1$, $F_1$, $F_2$, $A_2$, which we summarize as follows:

$$\frac{-A_1 k_{z1}}{\epsilon_1}=\frac{A_2 k_{z2}}{\epsilon_2} \tag{36}$$

$$F_l=F_2$$

$$F_l=-j\eta_1 A_l$$

$$F_2=j\eta_2 A_2$$

The four equations in (36) can not be satisfied simultaneously unless $$\frac{\eta_1\epsilon_1}{k_{z1}}=\frac{\eta_2\epsilon_2}{k_{z2}} \tag{37}$$

$$\frac{k_1}{k_{z1}}=\frac{k_2}{k_{z2}} \tag{38}$$

-continued $$\left[1-\left(\frac{k_\rho}{k_1}\right)^2\right]^{1/2}=\left[1-\left(\frac{k_\rho}{k_2}\right)^2\right]^{1/2} \quad (39)$$

We see that Eq. (39) can be satisfied only if $$k_1=k_2 \text{ or } \epsilon_1=\epsilon_2 \quad (40)$$

This means that the m=1 spiral mode cannot be supported by the dielectric-backed spiral shown in FIG. 2 without significant components of higher-order modes. This finding explains why earlier efforts to design a broadband spiral microstrip antenna failed.

3. Experimental Results Verifying the Theoretical Basis of the Mounting Arrangement The effect of the presence of high-dielectric-constant material on the performance of the antenna was studied in two ways: with and without a ground plane. To investigate the case of no ground plane, both calculations and measurements were used. The basic conclusion was that patterns degrade in the presence of a dielectric substrate; the higher the dielectric constant, and the thicker the substrate, the more seriously the patterns degrade. Even though dielectric substrates cause pattern degradation, it is possible to design spiral microstrip antennas with acceptable performance over a narrower frequency band.

The case of dielectric substrates between the spiral and the ground plane was studied for materials of relatively small dielectric constant, the greatest being 4.37, and little degregation was found at these frequencies. The studies were conducted using the configuration of FIG. 1 with a substrate of 0.063 inches of fiberglass, and for a substrate of 0.145 inches of air. In both of these configurations, the electrical spacing is the same (within 10%).

Figure 11A:
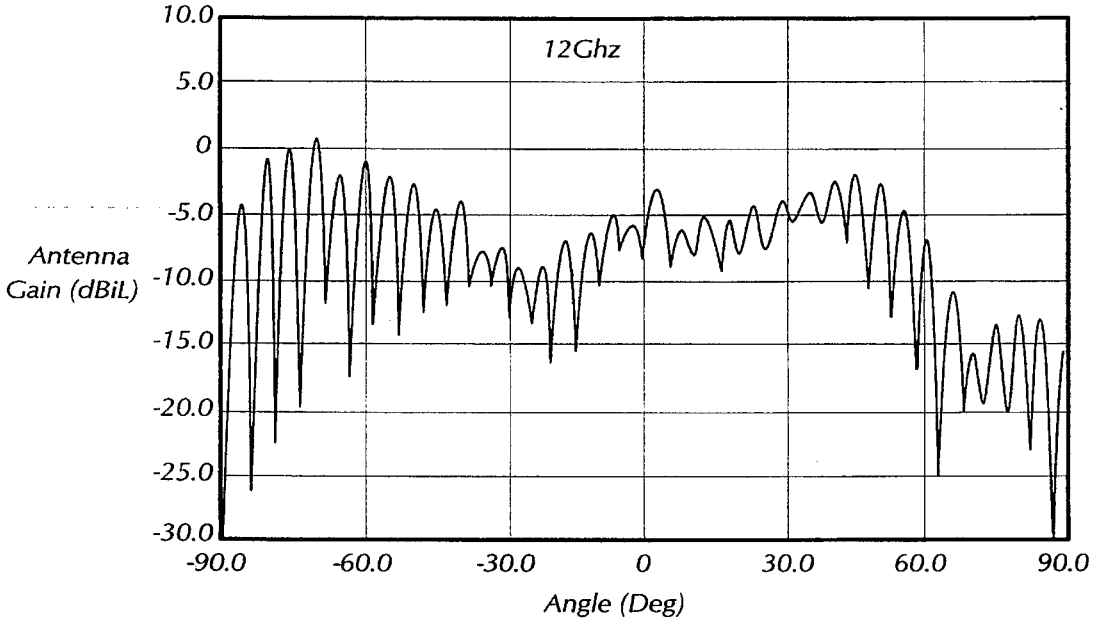
FIGS. 11A and 11B are graphs of experimental laboratory results of the disruptive effect of the dielectric substrate (when the dielectric constant is great) on the radiation pattern of an antenna as shown in FIG. 1.
Figure 11B:
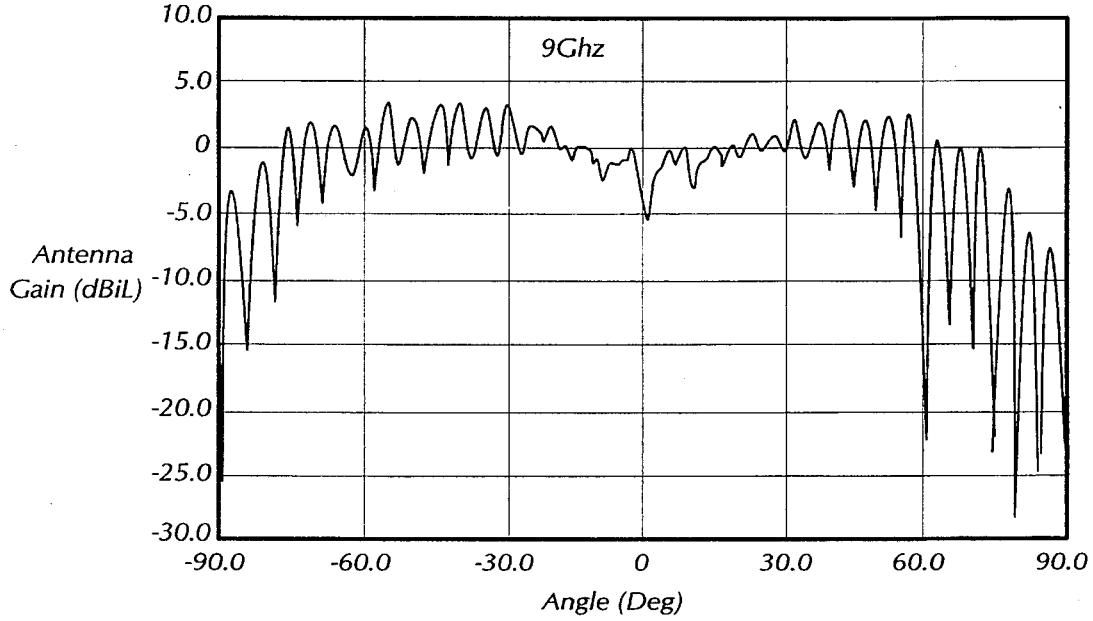

On the other hand, FIGS. 11A and 11B show some disruptive effect on the mode-1 radiation patterns at 9 and 12 GHz for an antenna with $\epsilon$=4.37 (fiberglass) and a substrate thickness of d=1/16 inch. When the substrate thickness d is reduced to 1/32 inch, the effect of the dielectric becomes larger, especially at lower frequencies. However, VSWR (voltage standing-wave ratio) remains virtually unaffected by the presence of the dielectric. We have thus demonstrated, both theoretically and experimentally, the disruptive effect of dielectric substrates on antenna patterns.

In many practical applications, the spiral microstrip antenna is to be mounted on a curved surface. To examine the effect of conformal mounting of the spiral microstrip antenna on a curved surface, we placed a 3-inch diameter spiral microstrip antenna on a half-cylinder shell with a radius of 6 inches and a length of 14 inches. The truncated spiral was placed 0.3-inch above and conformal to the surface of the cylinder with a styrofoam spacer. A 0.5 inch-wide ring of microwave absorbing material was placed at the end of the truncated spiral, with half of the absorbing material lying inside the spiral region and half outside it. The ring of absorbing material was 0.3-inch thick, thus filling the gap between the spiral antenna element and the cylinder surface.

The VSWR measurement of the spiral microstrip antenna conformally mounted on the half-cylinder shell was below 1.5 between 3.6 GHz and 12.0 GHz, and was below 2.0 between 2.8 GHz and 16.5 GHz. Thus, a 330% bandwidth was achieved for VSWR of 1.5 or lower, and a 590% bandwidth for VSWR of 2.0 or lower was reached.

The measured radiation patterns over $\Theta$ on the y-z principal plane with $\Phi$=90° yielded good rotating-linear patterns obtained over a wide frequency bandwidth of 2–10 GHz. Measured radiation patterns on the x-z principal plane ($\Phi$=0°) over $\Theta$ are of the same quality. Thus, the spiral-mode microstrip antenna can be conformally mounted on a curved surface with little degradation in performance for the range of radius of curvature studied here.

Recently, a researcher has reported a theoretical analysis which indicated that poor radiation patterns are due to the residual power after the electric current on spiral wires (not "complementary") has passed through the first-mode radiation zone which is on a centered ring about one wavelength in circumference. (H. Nakano et al., "A Spiral Antenna Backed by a Conducting Plane Reflector", IEEE Trans. Ant. Prop., Vol. AP-34, pp. 791–796 (1986)). Thus, if one can remove the residual power from radiation, it should be possible to obtain excellent radiation patterns over a very wide bandwidth.

One technique for removing the residual power is to place a ring of absorbing material at the truncated edge of the spiral outside the radiation zone. This scheme allows the absorption of the residual power which would radiate in "negative" modes, which cause deterioration of the radiation patterns, especially their axial ratio. This scheme is shown in FIGS. 1 and 2A by the provision of the loading ring 33.

Performance tests were conducted for a configuration similar to that shown in FIG. 1, except that the spiral was Archimedean as shown in FIG. 7, with a separation between the arms of about 1.9 lines per inch. The experimental results demonstrate that for a spacing d (standoff distance) of 0.145 inch, the impedance band is very broad—more than 20:1 for a VSWR below 2:1. The band ends depend on the inner and outer terminating radii of the spiral. The feed was a broadband balun made from a 0.141 inch semi-rigid coaxial cable, which made a feed radius of 0.042 inch. It was necessary to create a narrow aperture in the ground plane in order to clear the balun. The cavity's radius was 0.20 inch, and its depth 2 inches. This aperture also affects the high frequency performance.

Other tests were performed using a log-spiral (equiangular spiral) 0.3 inch above a similar ground plane and balun. Both spirals, incidentally, were "complementary geometries".

The diameter of each spiral (the Archimedean and the equiangular) was 3.0 inches, with foam absorbing material (loading) extending from 1.25 to 1.75 inches from center. If this terminating absorber is effective enough, the antenna match can be extended far below the frequencies at which the spiral radiates significantly. More importantly, at the operating frequencies, the termination eliminates currents that would be reflected from the outer edge of the spiral and disrupt the desired pattern and polarization. These reflected waves are sometimes called "negative modes" because they are mainly polarized in the opposite sense to the desired mode. Thus, their primary effect is to increase the axial ratio of the patterns.

Figure 12:
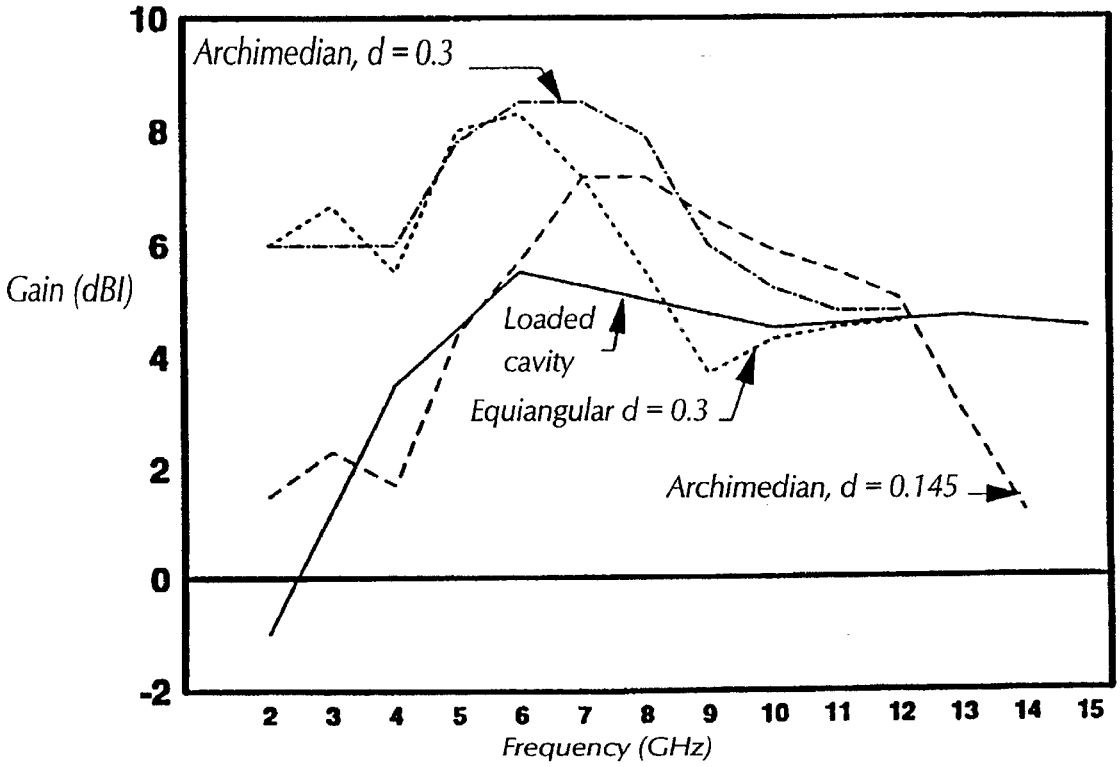
FIG. 12 is a graph of laboratory results comparing antennas according to the present invention with a prior cavity-loaded spiral antenna.

For an engineering model, the Archimedean and equiangular antennas operate well from 2 to 14 GHz, a 7:1 band. It is expected that the detailed engineering required to produce a commercial antenna would yield excellent performance over most of this range. The gain is higher than that of a 2.5" commercial lossy-cavity spiral antenna up through 12 GHz, as shown in FIG. 12. (We believe that the dip at 4 GHz is an anomaly.) The increased gain of antennas of the present invention over a lossy-cavity spiral antenna is in part attributable to the relative lack of loss of radiated power from the underside of the spiral mode antenna elements. The spiral mode antenna element radiates to both sides, with radiation from the underside passing through the dielectric backing and the dielectric substrate relatively undiminished. This radiation is reflected by the ground plane (sometimes more than once) and augments the radiation emanating from the upper side.

FIG. 12 also shows gain curves for a ground plane spacing of 0.3 inch. The Archimedean version of this design demonstrates a gain improvement over the nominal loaded-cavity level of 4.5 dBi (with matched polarization) over a 5:1 band. The gain of the 0.145 inch spaced antenna is lower because the substrate was a somewhat lossy cardboard material rather than a light foam used for the 0.3 inch example.

Figure 13:
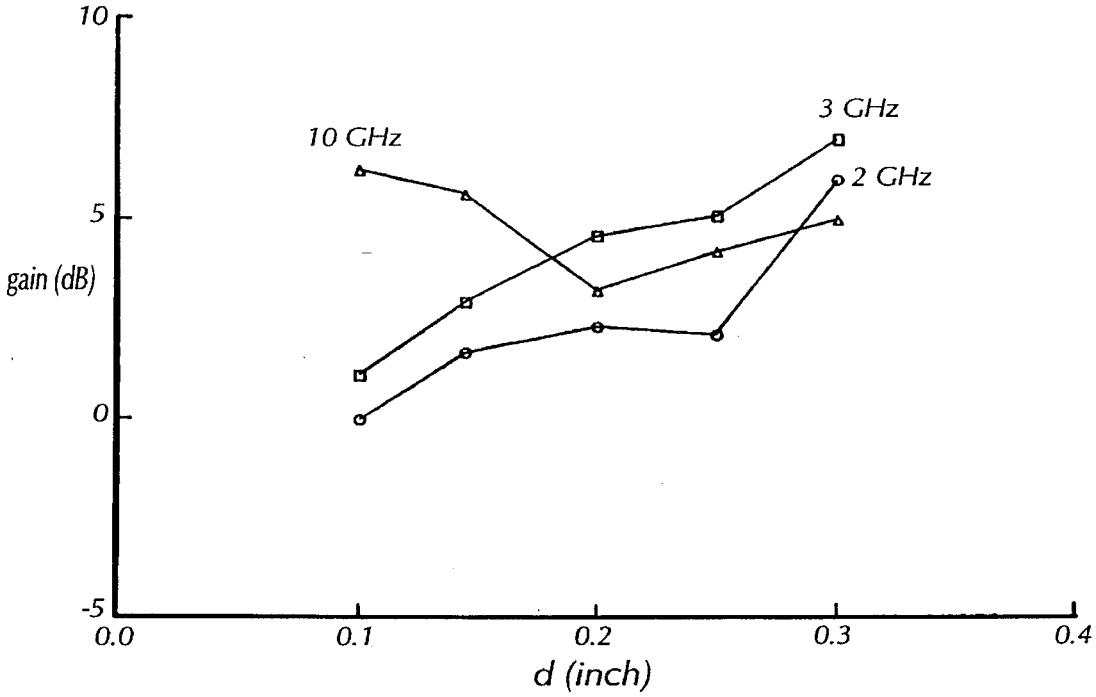
FIG. 13 is a graph of laboratory results for the antenna of FIG. 1 showing the effect of positioning the antenna element on antenna gain at various spacings from the ground plane for three different operating frequencies.

We have found that a decrease in thickness causes the band of high gain to move upwardly in frequency, subject to the limitation imposed by the inner truncation radius. FIG. 13 shows gain plotted at several frequencies as a function of spacing for a "substrate" of air. At low frequencies, the spiral arms act more like transmission lines than radiators as they are moved closer to the ground plane. They carry much of their energy into the absorber ring, and the gain decreases.

For these types of antennas, we have found that efficient radiation generally can take place even when the spacing is far below the quarter wave "optimum". We have observed a gain enhancement over that of a loaded cavity for frequencies that produce a spacing of less than 1/20 wavelength. If one is willing to tolerate gain degradation down to 0 dBi at the low frequencies, as found in most commercial spirals, the spacing can be as small as 1/60th wavelength.

We investigated several configurations of edge loading, most notably foam absorbing material and magnetic RAM (radar absorbing materials) materials. For the foam case, we compared log-spirals terminated with a simple circular truncation (open circuit) and terminated with a thin circular shorting ring. There was no discernable difference in performance. The magnetic RAM absorber was tried on open-circuit Archimedean and log-spirals with spacings of 0.09 and 0.3 inches. The results show that the magnetic RAM is not nearly so well-behaved as the foam. In addition to the gain loss caused by the VSWR spikes, the patterns showed a generally poor axial ratio, indicating that the magnetic RAM did not absorb as well as the foam. In our measurements, the loading materials were always shaped into a one-half-inch wide annulus, half within and half outside the spiral edge. The thickness was trimmed to fit between the spiral and the ground plane, and in the very close configurations it was mounted on top of the spiral.

This disclosure presents an analysis, supported by experiments, of a multi-octave, frequency-independent or spiral-mode microstrip antenna according to the present invention. It shows that the spiral-mode structure is compatible with a ground plane backing, and thus explains why and how the spiral-mode microstrip antenna works.

It is shown herein, both theoretically and experimentally, that a high dielectric substrate has a disruptive effect on the radiation pattern, and therefore that a low-dielectric constant substrate is preferred in wideband microstrip antennas. This finding may explain why earlier attempts to develop a spiral microstrip antenna have generally failed. It is also shown herein experimentally that a conformally mounted spiral microstrip antenna can achieve a frequency bandwidth of 6:1 or so.

Figure 14:
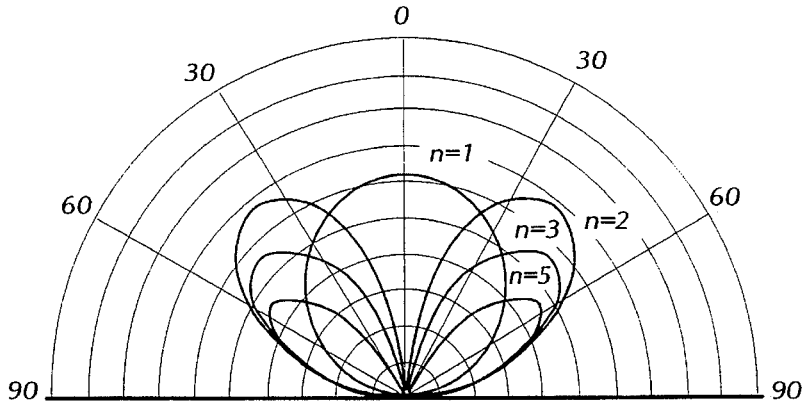
FIG. 14 is a graph of antenna radiation patterns, specifically, spiral mode patterns (for n=1, n=2, etc.).

"Spiral modes", as that term is used herein, refers to eigenmodes of radiation patterns for structures such as spiral and sinuous antennas. Indeed, each of the spiral, sinuous, log-periodic tooth, and rectangular spiral antenna elements disclosed herein as examples of the present invention exhibit spiral modes. A "spiral-mode antenna element" is an antenna element that exhibits radiation modes similar to those of spiral antenna elements. A mode can be thought of as a characteristic manner of radiation. For example, FIG. 14 shows some typical spiral modes for a prior spiral antenna, and particularly shows modes n=1, n=2, n=3, and n=5. Here, the axis perpendicular to the plane of the antenna points to zero degrees in the figure. The "spiral mode" antenna elements disclosed herein as part of a microstrip antenna radiate in patterns roughly similar to, though not necessarily identical with, the patterns of FIG. 14. As shown in FIG. 14, the spiral mode radiation pattern for n=1 is apple-shaped and is preferred for many communication applications. In such applications, the donut-shaped higher order modes should be avoided to the extent possible (as by using only two spiral arms) or suppressed in some manner.

"Multioctave", as that term is used herein, refers to a bandwidth of greater than 100%. "Frequency-independent", as that term is used herein in connection with antenna elements and geometry patterns formed therein, refers to a geometry characterized by angles or a combination of angles and a logarithmically periodic dimension (excepting truncated portions), as described in R. H. Rumsey in Frequency Independent Antennas, supra.

To obtain near maximum gain at a given frequency, the stand-off distance d should be between 0.015 and 0.30 of a wavelength of the waveform in the substrate (the dielectric spacer). With regard to the relative dielectric constant of the substrate, applicants have found that materials with $\epsilon$ of between 1 and 4.37 work well, and that a range of 1.1 to 2.5 appears practical. A higher dielectric constant (5 to 20) leads to gradual narrowing of bandwidth and deterioration of performance which nevertheless may still be acceptable in many applications. This and other design configurations, which operate satisfactorily for a specific frequency range, can be changed so that the antenna will work satisfactorily in another frequency range of operation. In such cases the dimensions and dielectric constant of the design are changed by the well known "frequency scaling" technique in antenna theory.

4. The Spiral-Mode Circular Array

Figure 15:
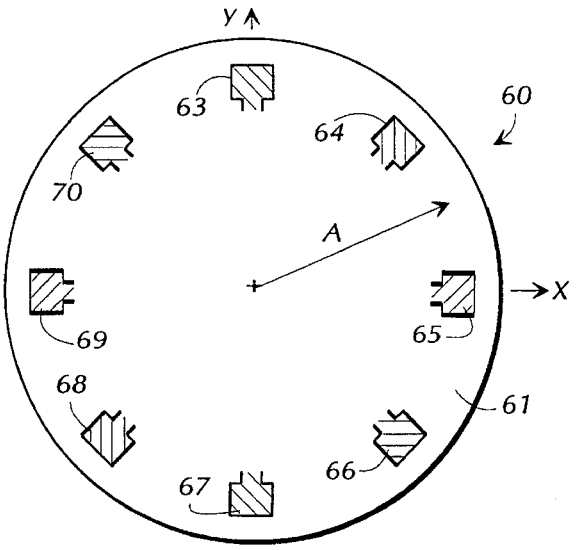
FIG. 15 is a schematic plan view of an antenna according to another preferred form and having closed array elements.
Figure 16:
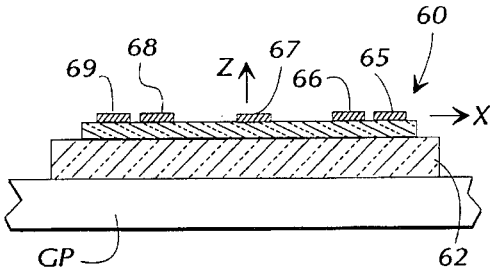
FIG. 16 is a side sectional view of the antenna of FIG. 15.

Referring now to FIGS. 15 and 16, the closed array of the present invention is considered. As shown in these figures, an antenna 60 is mounted above a ground plane GP and includes a somewhat stiff, comformable backing 61. The backing 61 is a unitary structure, preferably made of printed circuit board material. The backing 61 is spaced above the ground plane GP by a dielectric spacer 62 in accordance with the principles set forth in the above numbered sections 1–3. A closed array or series of patch elements 63, 64, 65, 66, 67, 68, 69, and 70, is formed atop the upper surface of the backing 61 by conventional techniques, such as by photoetching. Preferably, the array is circular, although what is essential is that the array be "closed", i.e., is generally of the form of a loop. While eight elements are depicted in FIG. 15, a greater or lesser number of elements can be used. In FIG. 16, the vertical dimensions of the patch elements and of the backing are exaggerated somewhat to make these elements more visually discernible in the figure. The patch elements 63–70 are connected to unshown electrical means for driving the individual elements, the driving means being adapted to drive the individual patch elements in a phased manner. The electrical circuitry used to phase signals delivered to the individual patch elements is well-known. In general, the signal is split up into several signals and delayed or phase-shifted an appropriate amount, by a network of "hybrids" sometimes called a "processor", before being delivered to the patch elements. Of course, the individual patch elements 63–70 are electrically coupled with the driving means in a manner similar to that shown in FIG. 2B, i.e., through the use of cabling or in another suitable manner.

The structure just described is extremely compact and is well-suited for being used on the surface of an object, for example, on the surface of an airplane. The antenna 60 with the array of individual antenna elements 63–70 has a small overall dimension for a bandwidth of 30 to 300%, depending on the diameter of the array. The applicants have found that this arrangement allows the antenna to be made substantially smaller than prior antennas at a sacrifice of some bandwidth and some gain, and that the smaller the diameter of the circular array, the smaller the bandwidth. As compared with the spiral arm antennas disclosed in the above-referenced co-pending U.S. patent application, the present invention allows the diameter of the antenna to be reduced by up to ⅔ or so. When compared with other prior antennas, such as the antenna arrays disclosed in the Munson IEEE paper, the reduction in physical size is even more dramatic. This reduction in size is achieved at a sacrifice of bandwidth and perhaps even gain. However, for many applications, 30 to 50% bandwidth is sufficient; yet such a bandwidth cannot be obtained by conventional microstrip patch antennas. Thus, the- spiral-mode circular array fills the need for a conformable, low-profile, antenna with a moderately wide bandwidth in the 30% to 300% range while the array diameter can be only ½ to ⅓ the spiral diameter.

The basic concept of a spiral-mode circular phased array is shown in FIG. 15. The circular array is on a x-y plane which is treated as a horizontal plane parallel to the earth. The array elements are on a circle of radius a, and can be represented as either magnetic or electric current elements, denoted by $J_m^n$ for the nth element of mode m.

The current $J_m^n$ must have a polarization, amplitude, and phase as follows:

$$J_n^m = \hat{\rho} J_m e^{-j\frac{mn}{N}\phi} \quad n = 1, 2, 3 \ldots N; \text{ for mode } m \tag{41}$$

where $\hat{\rho}=\cos\phi\hat{x}+\sin\theta\hat{y}$, $\hat{\rho}$ being a unit radial vector in the cylindrical coordinates. The pattern of this array remains the same if the polarizations of the current sources are changed to $\hat{\Phi}$, that is, if $$J_n^m = \hat{\phi} J_m e^{-j\frac{mn}{N}\phi} \quad n = 1, 2, 3 \ldots N; \text{ for mode } m \tag{42}$$

Figure 17A:
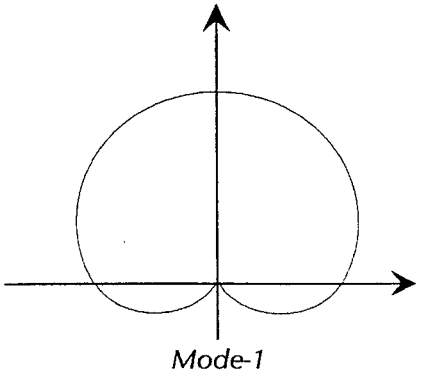
FIGS. 17A and 17B are graphs of radiation patterns for modes m=1 and m=2, respectively.
Figure 17B:
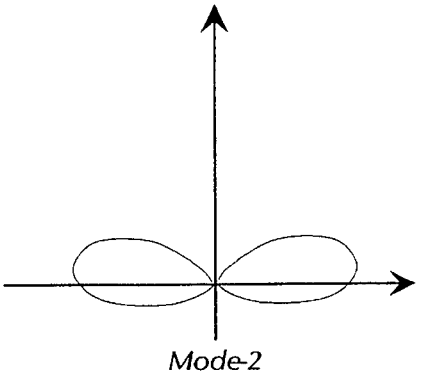

When m=1, the radiation pattern of this circular array is apple-shaped as shown in FIG. 17A. When m=2 or higher, the radiation pattern is that of the doughnut shape shown in FIG. 17B. Thus, this circular array can provide the spatial coverage shown in FIGS. 17A and 17B. Now if two or more of these modes are combined, the resultant pattern has a narrower steerable beam, as well as one or more steerable nulls for noise or interference reduction.

This multi-mode circular array alternatively can be realized, as in the co-pending patent application, by a multimode planar spiral, for which the radiation current band theory is well known. However, the planar spiral requires a much larger aperture, because its radiation occurs on a circle whose circumference is mλ in length. For example the m=1 mode of a planar spiral radiates on a circumference of one wavelength (1λ), and the m=2 mode radiates on a 2λcircumference. Thus, for higher mode numbers, the planar spiral can be unattractively large.

In the multi-mode circular array disclosed herein, radiation occurs on the circle of radius a, where the array elements are located. Theoretically, the array radius a can be arbitrarily small. In reality, the tolerance of the array becomes increasingly stringent as the array diameter is reduced to below about 0.3λ for mode 1 and 0.6λ for mode 2. By a simple array factor analysis, one can show that the axial ratio deteriorates at angles away from the antenna axis (z axis) and that the axial ratio increases as the array size (in wavelength) decreases.

As has been pointed out, a major advantage of this spiral-mode circular array is its ability to radiate, especially for higher-order modes (m >2), on a smaller aperture. For example, to radiate an m=3 mode, a planar spiral needs to have a circumference of more than 3λ (a diameter of 0.955λ). For the mode-3 circular array, a λ circumference (0.318λ in diameter) is acceptable. However, it has been observed that the tolerance requirements on the feed network becomes more and more stringent for smaller apertures.

5. Bandwidth Coverage of the Array Arrangement

Figure 18:
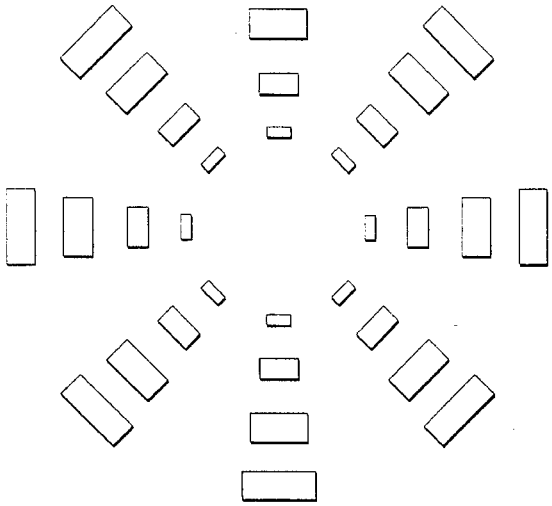
FIG. 18 is a schematic plan view of an alternative embodiment in which concentric circular arrays of elements are arranged.

Two techniques can be employed to expand the bandwidth of the array to 10:1 or more:

(a) Concentric circular arrays,
as shown in FIG. 18, wherein four concentric circular arrays are shown, only two of which are needed for the breadboard model; and (b) Element broadbanding.

The individual microstrip patch antenna is known for its narrow bandwidth, typically 10% and often 3 to 6%. By increasing its effective cavity, the bandwidth of a microstrip antenna can be increased. For example, with a substrate of 0.318 cm, and a related permittivity of 2.32, the bandwidth at 10 GHZ is about 20%. In addition, by having the patch elements closely spaced with each other, the impedance bandwidth of the array can be made much larger than that of the individual array elements. By employing a dissipative loading similar to that of the planar spiral or the circular array of loaded loops, a bandwidth of 3:1 can be reached with a loss no more than that of the cavity-loaded spiral antenna.

Although dissipative loss, perhaps on the order of 2 dB, is an undesirable feature it is more than compensated for by a higher gain from the antenna patterns and the anti-jamming capability against noise. As a result, the signal-to-noise ratio of the antenna disclosed herein should be equivalent to the single-element low-gain antennas with broad apple or doughnut beams.

Figure 19:
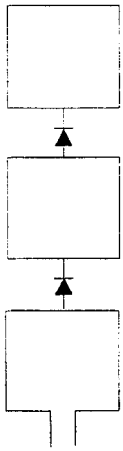
FIG. 19 is a schematic illustration of a tunable multiple-resonance-frequency microstrip antenna switched by PIN diodes.

To broaden the tunable frequency bandwidth, one can switch the effective length of a microstrip antenna with PIN diodes as shown in FIG. 19. This technique of switching the effective length of a microstrip structure has been experimentally investigated and analyzed in some instances. The high temperature limits for this diode-switching device are yet to be determined.

6. Using Magnetic Substrate To Reduce Antenna Size

Figure 20:
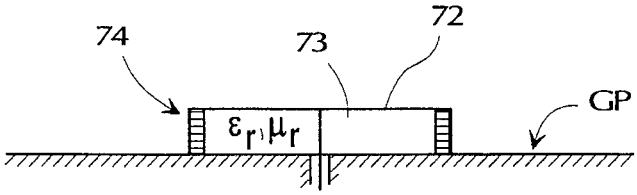
FIG. 20 is a schematic illustration showing that a substrate material used in a spiral-mode microstrip antenna with roughly equal relative permittivity and permeability.

In a manner similar to that in the above-noted patent application Ser. No. 07/695,686, we have determined that if the substrate between the antenna element and the ground plane is a magnetic material (preferably, a ferromagnetic material) with roughly equal relative permittivity and permeability, the spiral modes can radiate effectively. As has been shown in the referenced patent application, with a substrate having high relative permittivity (say, greater than 5) the antenna pattern begins to deteriorate. However, when its relative permittivity and permeability are roughly equal, the substrate is compatible with the spiral modes and therefore good radiation patterns for each mode can be generated without other unwanted modes that can disrupt the pattern. This is depicted in FIG. 20 wherein antenna element(s) 72 is positioned atop a magnetic substrate 73 having roughly equal relative permittivity and permeability. A loading material 74 is placed about the periphery.

Now, if the relative permittivity and permeability of the magnetic substrate are chosen to be a higher number, say, 10, then the wavelength in the substrate will be only 1/10 (10%) of that in free space. This allows the antenna size to be reduced to nearly 1/10 (one-tenth) of its size when using a honey-comb substrate (relative permittivity and permeability being close to unity).

FIG. 20 shows that a magnetic material is used as the substrate 73 for the spiral-mode microstrip antenna. By carrying out an analysis similar to that in Section 2, we have demonstrated that if the relative permittivity $\epsilon_r$ equals the relative permeability $\mu_r$, the structure shown in FIG. 20 is compatible with the spiral modes. In other words, when $\epsilon_r \cong \mu_r$, the substrate is not expected to disrupt the spiral modes as the ordinary dielectric substrates do. (For an ordinary dielectric material, $\mu_r=1$, while $\epsilon_r$ is a number larger than 1; thus $\epsilon_r \neq \mu_r$.)

Now if we use as substrate a material with $\epsilon_r \cong \mu_r$, we can reduce the physical size of the antenna by the factor $\sqrt{\epsilon_r \mu_r}$, or approximately $\epsilon_r$ (since $\epsilon_r \cong \mu_r$). For example, if we use a material with $\epsilon_r \cong \mu_r \cong 10$, we can reduce the size of the antenna (both the thickness of the substrate and the diameter of the frequency-independent element) by a factor of 10. That is, we can reduce its size to nearly 1/10 of its size when using a substrate with its permittivity near that of free space ($\epsilon_r \cong 1$).

At present, no ready-made material with equal relative permittivity and permeability appears to be commercially available. However, custom materials can be constructed by mixing grains of two materials to achieve equal, or nearly equal, relative permittivity and permeability. The size of the grains must be small in comparison with wavelength (in the material), and must be uniformly distributed to achieve homogeneity on a macroscopic scale. For example, two different types of cubes, one more dielectric and the other more magnetic, and with their linear dimensions being identically equal to 0.1 wavelength (in the material), can be alternately spaced to approximate a homogeneous material of equal relative permittivity and permeability.

Another method of making custom magnetic material for substrate of equal $\epsilon_r$ and $\mu_r$ is to place electrically thin dielectric and magnetic sheets parallel to the ground plane alternately in a stack. (Sheets placed perpendicular to the ground plane should have similar effects.) The stack then appears macroscopically to be homogeneous with equal $\epsilon_r$ and $\mu_r$. For example, sheets with $\epsilon_r=3-j0.1$ and $\mu_r=1$ can be alternately stacked with sheets with $\epsilon_r=1$ and $\mu_r=3-j0.1$ to achieve this effect (the imaginary part j0.1 is related to the dissipation of the material and is chosen to be small, j0.1 is a practical choice; other small numbers are acceptable.)

7. Varying Effective Substrate Thickness In a mode-2 Antenna

The physical size of a mode-2 antenna, which generally has a larger and more complex feed network, can be reduced by varying the effective thickness of the substrate. A simple coax feed at the center excites a transmission-line wave propagating away from the center along the spiral structure, thereby forming spiral modes. In the region covered by a circle with a circumference slightly over one wavelength, the substrate is sufficiently thin so that m=1 radiation is minimal. Outside this region the effective thickness of the substrate is increased so that radiation of mode-2 is effective.

The advantage of this mode-2 antenna is not only a reduction in physical size, including that of its feed, but also a reduction in cost, improvement in reliability and greater structural simplicity.

As shown in FIG. 12, the gain of the spiral-mode microstrip antenna drops sharply when the spacing between the antenna element and the ground plane is decreased to below, say, 0.02 wavelength. This phenomenon is taken advantage of in the following mode-2 antenna.

Figure 21A:
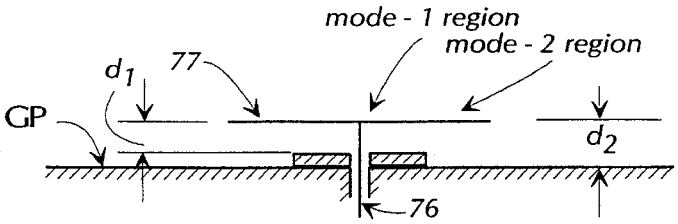
FIGS. 21A and 21B show mode-2 antennas with a non-constant spacing above the ground plane.
Figure 21B:
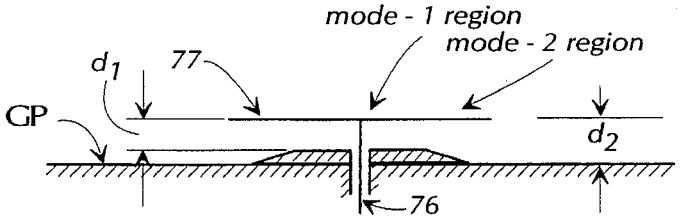

FIGS. 21A and 21B show two versions of a simple illustrative design in which the center conductor of a coaxial line 76 is fed through a ground plane GP to the center of a spiral structure 77. The two spiral arms within the mode-1 radiation region (where the circumference is less than 1.1 wavelength) join at the center with the center conductor of the coaxial line. Also, the fine Archimedean spiral arms as shown in the mode-2 region (outside the circumference of 1.1 wavelength) are broadened in the mode-1 region. The specific pattern of the broadening of the arms is not critical as long as it transforms the impedance (usually 50 ohms of the coax cable at the center into the impedance of the spiral microstrip structure.

Radiation in the mode-1 region is minimized by choosing $d_1$, the spacing between the spiral element 77 and the ground plane, to be electrically small (less than say, 0.02 wavelength).

However, as the wave moves outwardly from the center of the spiral structure and enters the mode-2 region (where the circumference is greater than about 1.1 wavelength), effective radiation takes place because the spacing $d_2$ between the spiral element 77 and the ground plane GP is now greater than about 0.05 wavelength. The fact that the radiation occurs in the mode-2 region means that the radiation pattern should be that of mode-2.

In FIG. 21A, the spacing between the spiral element 77 and the ground plane abruptly changes from $d_1$ in the mode-1 region to $d_2$ in the mode-2 region. In this version, radiation in mode-2 is effective. However, the abrupt increase in spacing for substrate thickness from $d_1$ to $d_2$ causes undesired reflections.

As shown in FIG. 21B, the reflection between mode-1 and mode-2 regions is reduced by employing a tapered section to effect a gradual increase in substrate thickness from $d_1$ to $d_2$. However, the mode-2 radiation is not as effective at frequencies at which mode-2 regions begins in the tapered transition region, since the smaller substrate thickness in the transition region suppresses radiation.

The taper between $d_1$ and $d_2$ shown in FIG. 21B can be linear or of some other smooth curve, the selection of which is a tradeoff among several considerations, including technical performance as well as production cost and ruggedness.

It is well known that the effect of the ground plane on the mode-2 radiation is generally negative. Therefore it is desirable, whenever possible, to reduce the size of the ground plane and/or to make it convexly curved so that, for example, the ground plane is a large conducting sphere and the spiral is positioned outside it.

The patch elements can comprise lossy components for impedance matching.

While the invention has been disclosed in preferred forms by way of examples, it will be obvious to one skilled in the art that many modifications, additions, and deletions may be made therein without departing from the spirit and scope of the invention as set forth in the following claims.

We claim:

1. A compact microstrip antenna for mounting to one side of a surface of a structure, comprising:

one or more antenna elements; and a ferromagnetic substrate adapted for positioning the antenna elements a selected distance from the surface, said ferromagnetic substrate having a relative permittivity and a relative permeability, said relative permittivity being roughly equal to said relative permeability.

2. A microstrip antenna as claimed in claim 1 further comprising a loading material positioned about a peripheral portion of said one or more antenna elements and adjacent the surface of the structure.

3. A compact microstrip antenna for mounting to one side of a surface of a structure, comprising:

one or more antenna elements; and a magnetic substrate adapted for positioning the antenna elements a selected distance from the surface, said magnetic substrate having a relative permittivity and a relative permeability, said relative permittivity being roughly equal to said relative permeability, wherein said substrate comprises alternating layers of dielectric material and magnetic material so that their resultant relative permittivity and relative permeability are approximately equal.

4. A microstrip antenna as claimed in claim 3 wherein the surface is a ground plane and said alternating layers of dielectric material and magnetic material are positioned parallel to said ground plane.

5. A compact microstrip antenna for mounting to one side of a surface of a structure, comprising:

one or more antenna elements; and a magnetic substrate adapted for positioning the antenna elements a selected distance from the surface, said magnetic substrate having a relative permittivity and a relative permeability, said relative permittivity being roughly equal to said relative permeability, wherein said antenna is adapted to operate at a selected wavelength and wherein said substrate is comprised of first and second granular materials, each of said first and second granular materials having a small grain size, and wherein the combined relative permittivity and relative permeability are approximately equal.

6. A microstrip antenna as claimed in claim 5 wherein, macroscopically, said first and second granular materials are uniformly distributed to achieve homogeneity in the distribution of said first and second granular materials comprising said substrate.

* * * * *